United States Patent [19]

Faulstich

[11] 4,109,816

[45] Aug. 29, 1978

[54] PLASTIC CAP FOR BOTTLE

[75] Inventor: George W. Faulstich, San Carlos, Calif.

[73] Assignee: Three Sisters Ranch Enterprise, San Carlos, Calif.

[21] Appl. No.: 737,384

[22] Filed: Nov. 1, 1976

[51] Int. Cl.[2] ..... B65D 41/32

[52] U.S. Cl. ..... 215/256

[58] Field of Search ..... 215/253, 254, 256; 220/270

[56] References Cited

U.S. PATENT DOCUMENTS

| | | | |
|---|---|---|---|
| 3,120,900 | 2/1964 | Faulstich | 215/256 |
| 3,142,403 | 7/1964 | Fox | 215/256 |
| 3,338,446 | 8/1967 | Faulstich | 215/256 |
| 3,441,161 | 4/1969 | Van Baarn | 215/256 |
| 3,608,765 | 9/1971 | Faulstich | 215/256 |
| 3,672,528 | 6/1972 | Faulstich | 215/256 |
| 3,927,784 | 12/1975 | Cochrane | 215/256 |

*Primary Examiner*—George T. Hall
*Attorney, Agent, or Firm*—Julian Caplan

[57] ABSTRACT

The cap of the present invention has a top disk which fits on the end of the neck of a bottle and a thin-walled outer skirt formed with a pair of circumferential beads which fit against mating portions of the bottle neck. A pair of parallel, circumferential internal score lines, defining a weakened cylindrical band, are formed in the outer skirt between the circumferential beads and in proximity to an integral tear tab. By pulling on the tab, the band is torn out of the outer skirt, permitting the upper portion of the cap above the band to be pulled off the neck. This upper portion can be replaced for reclosure purposes. Preferably, the cap is formed with an integral, smaller diameter "corking" skirt which fits inside the bottle neck.

10 Claims, 4 Drawing Figures

PLASTIC CAP FOR BOTTLE

This invention relates to a new improved deformable plastic cap for bottles and to the combination of bottle and cap.

One use for the present invention is to seal a wine bottle, although the cap may be used to seal other types of bottles.

Heretofore, wine bottles have generally been sealed with cork forced into the bottle neck. The present invention is a replacement for such cork.

An advantage of the invention is the fact that the seal is very tight in that the locations of sealing are not only the inside of the neck but also the upper edge or finish of the neck and the exterior of the neck. Hence the sealing against leakage of contents and ingress of air is improved over conventional bottle caps and closures.

A further feature of the invention is the fact that the cap may be easily installed on the bottle neck by automatic machinery.

Further, the cap may be removed merely by pulling a finger tab, tearing from a portion of the outer skirt a weakened band, which reduces the friction between the cap and the bottle neck and permits manual removal.

Still another feature of the invention is the fact that the cap after being torn results in a residual reclosure cap which may be used repeatedly. When the reclosure cap is in place, the bottle is protected to a certain extent against ingress of air and also is protected against leakage of the contents.

A still further feature of the invention is the fact that the outer skirt of the cap when intact prevents removal of the cap, and hence prevents tampering with the contents. On the other hand, once the weakened band is removed the purchaser can detect the fact that the content of the bottle has been subject to tampering.

Other objects of the present invention will become apparent upon reading the following specification and referring to the accompanying drawing in which similar characters of reference represent corresponding parts in each of the several views.

Figure 1:
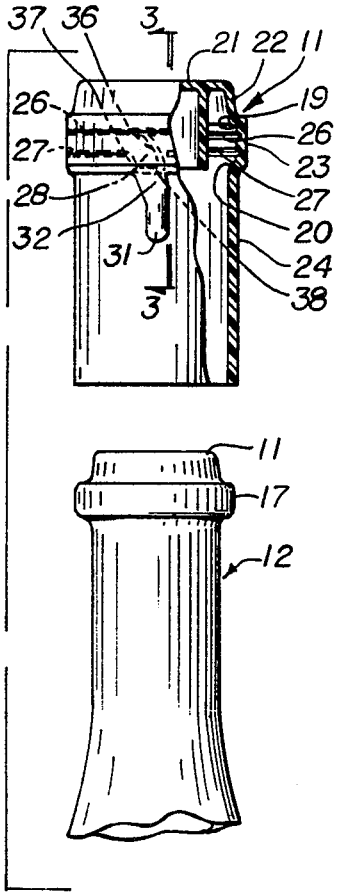
FIG. 1 is an exploded side-elevational view partly broken away to reveal internal construction of a cap and bottle.

The present invention provides a cap 11 for a conventional bottle neck 12, here shown as a wine bottle. The cap is so formed that a weakened band 13 may be manually removed from the cap 11, permitting the upper portion of the cap to be pulled off the neck and constituting a reclosure cap 14 for reclosure purposes.

The bottle neck 12 has a lip or finish 16 at its top. Where the cap is used on a wine bottle, the neck 12 is formed with an external, approximately rectangular cross-section bead 17 spaced downward from the finish 16. The inside of neck 12 is approximately cylindrical.

Cap 11 fits tightly on the upper portion of neck 12. For such purpose, it is formed with a top disk 21 preferably flat both inside and out. Extending below top disk 21 is a peripheral top portion 22 of the outer skirt. Top portion 22 has length about equal to the height of neck 12 above bead 17. Below top portion 22 are a pair of circumferential beads 19, 20 having inside diameters to fit tightly against the indentations at the top and bottom edges of bead 17. Below bead 20 is the bottom 24 of the outer skirt.

The thin-walled outer skirt consisting of the portions 22, 23 and 24 fits snugly against the outside of the neck 12; and when intact, the cap cannot be removed from the bottle and hence the possibility of tampering with the contents is prevented. It is also apparent that there is a liquid type seal between the inside of the top disk 21 and the finish 16 and also between the exterior of the neck 12 and the bead 17 thereof and the interior of the outer skirt and particularly beads 19, 20 of the cap. The ingress of air is prevented by the sealing surfaces.

Two circumferential vertically spaced apart internal score lines, namely, upper line 26 and lower line 27 are preferaably formed in skirt section 23 between beads 19, 20, and form weakened band 13. A gap 28 of a short arcuate distance can be formed into the lower line 27. Immediately below gap 28 is an integral tear tab 31 formed on the exterior of lower skirt portion 24. A first internal curved score line 36 on skirt portion 23 extends from the upper right corner (as viewed in FIG. 1) of tab 31 generally upward and to the left until it merges with upper circumferential score line 26. Similarly, a second, shorter radius, internal curved score line 37 extends from the upper left corner of tab 31 generally upward and to the left until it merges with lower circumferential score line 27. Below the level of lower score line 27 the skirt section 23 is thinned in area 38 immediately under the upper end of tear tab 31. To prevent the tab 31 from being torn apart, it is preferably formed with a reinforcement 32 angling upwardly to the band 13.

In the preferred embodiment of the invention illustrated in the accompanying drawings there is an inner or "corking" skirt 34 depending from disk 21 and fitting tightly against the inside surface 18 of the neck 12. This skirt 34 augments the sealing of the cap 11 and further facilitates the positioning of the reclosure cap 14.

Cap 11 may be installed on the neck 12 by automatic capping machinery. For such purpose, the portion of neck 12 above bead 17 slants slightly downwardly-outwardly as best shown in FIG. 1. This portion fits inside the lower edge of lower skirt portion 24. Downward pressure applied to top disk 21 stretches the skirt 24 outwardly. The lower edge of inner skirt 34 slips inside neck 12. When cap 11 is seated, there is a sealing between the inner skirt 34 and the inside 18 of the neck 12, also between the finish 16 and the underside of the top disk 21 and also of the exterior of neck 12 with the portions 22, 23, 24 and particularly beads 19, 20. When intact, the cap 11 cannot be removed by any ordinary means.

Figure 2:
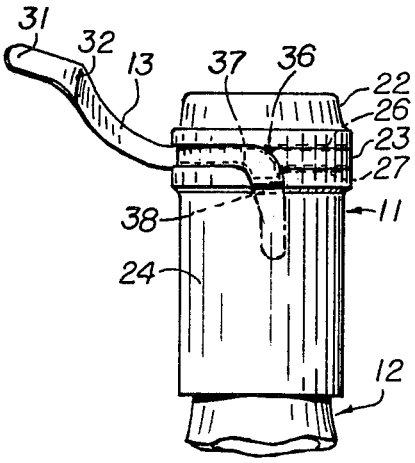
FIG. 2 is a view similar to FIG. 1 showing the cap and bottle assembled and also showing the weakened band partially torn away.
Figure 3:
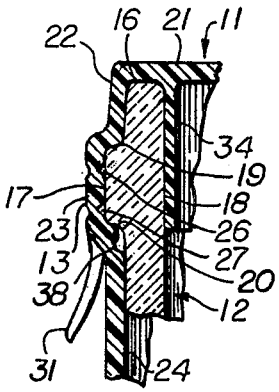
FIG. 3 is a sectional view taken substantially along the line 3—3 of FIG. 1 prior to removal of the weakened band.

When it is decided to open the bottle, the user grasps the tab 31 and pulls upward and toward the left as viewed in FIGS. 1 and 2. As the tab 31 is lifted and pulled the thinned area 38 fractures, permitting the tab to be torn upward. Skirt portion 23 tears along curved lines 36, 37. The tear at line 36 merges with line 26 and the tear at line 37 merges with line 27. Further pulling on tab 31 tears lines 26 and 27 around the cap. By thus continuing to pull on the tab 31 around the bottle, the entire band 13 between lines 26 and 27 is removed.

Figure 4:
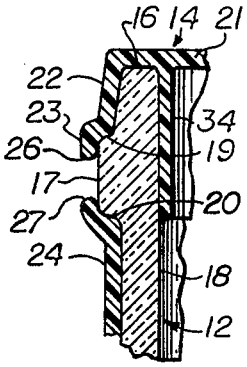
FIG. 4 is a view similar to FIG. 3 showing the weakened band removed and the use of the upper portion of the cap as a reclosure cap.

The user pries the cap from the bottle neck. One means for removing the cap is by the fingers gripping the underside of the reclosure cap 14 shown in FIG. 4. In the condition of FIG. 4 the resistance to the removal of the reclosure cap 14 is considerably less than to the cap 11 because a lesser surface area of contact between the skirt and the neck remains and also because the lower portion 24 below the bead 17 has been disconnected from the reclosure cap 14 and the shoulder on the lower side of the bead 17 no longer prevents upward pulling of the cap 14.

After a portion of the contents of the bottle has been dispensed, it is possible to use the reclosure cap 14. The inner skirt 34 guides the reclosure cap 14 in place as the inner skirt 34 is inserted inside the surface 18 of neck 12 and a downward manual force on disk 21 causes the cap to seat into the position of FIG. 4. There is sufficient contact between the inner skirt 34, underside of top disk 21 and upper portion 22 of reclosure cap 14 to prevent leakage of the contents of the bottle under ordinary conditions and also to prevent the ingress of air. However, the cap 14 is easily installed and removed as compared with the cap 11.

Although only one specific embodiment of the invention has been described, it is understood that changes and modifications can be made without departing from the spirit thereof, as set forth in the following claims.

What is claimed is:

1. In combination a wine bottle having a neck formed with an annular finish at the upper end of said neck, the outside of said neck shaped with a short, cylindrical outside upper surface below said finish, a first bead below said upper surface and an elongated cylindrical outside lower surface below said first bead, said upper and lower surfaces being of about the same diameter, said neck being formed with a cylindrical inner surface below said finish and a thin-walled, flexible plastic cap for closing said bottle, said cap being deformable to stretch over said bead, said cap comprising a top disk having a diameter about equal to said finish, a thin-walled outer skirt depending from said disk, said outer skirt having a top portion shaped to fit tightly around said upper surface, a pair of internal beads shaped to fit tightly around the edges of said first bead, a bottom portion shaped to fit around at least a portion of said lower surface and a pull tab depending below said pair of internal beads, vertically spaced apart under and lower score lines being located between said pair of internal beads which weaken said outer skirt when said tab is pulled so that a circumferential band may be torn off between said score lines, permitting removal of the portion of said cap above said upper score line.

2. The combination of claim 1 in which said lower score line is interrupted for a short arcuate length and said tab is located adjacent the interrupted portion of said lower score line.

3. The combination of claim 2 in which said tab is molded integral with said cap.

4. The combination of claim 1 which further comprises an inner corking skirt depending from said disk dimensioned to fit tightly inside said inner surface of said neck.

5. A thin-walled, flexible plastic cap for closing a wine bottle having a neck formed with an annular finish at the upper end of said neck, the outside of said neck shaped with a short, cylindrical outside upper surface below said finish, a first bead below said upper surface and an elongated cylindrical outside lower surface below said first bead, said upper and lower surfaces being of about the same diameter, said neck being formed with a cylindrical inner surface below said finish; said cap being deformable to stretch over said bead, said cap comprising a top disk having a diameter about equal to said finish, a thin-walled outer skirt depending from said disk, said outer skirt having a top portion shaped to fit tightly around said upper surface, a pair of internal beads shaped to fit tightly around the edges of said first bead, a bottom portion shaped to fit around at least a portion of said lower surface and a pull tab depending below said pair of beads, vertically spaced apart upper and lower score lines being located between said pair of beads which weaken said outer skirt when said tab is pulled so that a circumferential band may be torn off between said score lines, permitting removal of the portion of said cap above said upper score line.

6. A cap according to claim 5 in which said lower score line is interrupted for a short arcuate length and said tab is located immediately below the interrupted portion of said lower score line.

7. A cap according to claim 6 in which said tab is molded integral with said cap.

8. A cap according to claim 5 in which said score lines are internal.

9. A cap according to claim 5 which further comprises an inner corking skirt depending from said disk dimensioned to fit tightly inside said inner surface.

10. A deformable plastic cap comprising:

(1) a top disk (2) a cylindrical thin-walled outer skirt integrally attached to and extending substantially perpendicularly from said disk; and (3) a cylindrical inner skirt integrally attached to and substantially perpendicular to said disk positioned inward and enclosed within said outer skirt and substantially coaxial therewith and extending for a shorter distance than said outer skirt; said outer skirt scored and weakened along a substantially circumferential first score line downwardly spaced from said disk, and scored and weakened along a substantially circumferential second score line spaced downwardly from said first score line to form a weakened cylindrical band within said outer skirt, a tab attached to said cylindrical band and extending from said band and outwardly from said outer skirt, a weakened area extending between said first score line and said second score line immediately adjacent said tab, said outer skirt being imperforate except is said weakened area, the portion of said cap above said band not being detachable from the portion of said outer skirt below said band except when said band has been torn off said outer skirt, and integral narrow bead means extending circumferentially around the inside of said outer skirt above said second score line.

* * * * *